US009990886B2

(12) United States Patent
Lee et al.

(10) Patent No.: US 9,990,886 B2
(45) Date of Patent: Jun. 5, 2018

(54) ORGANIC LIGHT-EMITTING DIODE DISPLAY

(71) Applicant: Samsung Display Co., Ltd., Yongin-si, Gyeonggi-do (KR)

(72) Inventors: Seungkyu Lee, Yongin-si (KR); Taehoon Kwon, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 14 days.

(21) Appl. No.: 15/360,845

(22) Filed: Nov. 23, 2016

(65) Prior Publication Data

US 2017/0169764 A1 Jun. 15, 2017

(30) Foreign Application Priority Data

Nov. 23, 2015 (KE) ..... 10-2015-0163979

(51) Int. Cl.

| | |
|---|---|
| ***G09G 5/10*** | (2006.01) |
| ***G09G 3/3258*** | (2016.01) |
| ***G09G 3/3233*** | (2016.01) |
| ***G09G 3/3266*** | (2016.01) |

(52) U.S. Cl.

CPC ..... *G09G 3/3258* (2013.01); *G09G 3/3233* (2013.01); *G09G 3/3266* (2013.01); *G09G 2300/043* (2013.01); *G09G 2300/0814* (2013.01); *G09G 2310/0262* (2013.01); *G09G 2310/08* (2013.01); *G09G 2320/0242* (2013.01)

(58) Field of Classification Search

CPC ..... G09G 2300/043; G09G 2300/0814; G09G 2310/0262; G09G 2310/08; G09G 2320/0242; G09G 3/3233; G09G 3/3258; G09G 3/3266

See application file for complete search history.

(56) References Cited

U.S. PATENT DOCUMENTS

2011/0084955 A1 4/2011 Kim
2013/0009917 A1* 1/2013 Hsu ..... G09G 3/3614 345/204
2013/0037817 A1 2/2013 Lee et al.
(Continued)

FOREIGN PATENT DOCUMENTS

KR 10-2011-0039773 A 4/2011
KR 10-2013-0016939 A 2/2013
(Continued)

*Primary Examiner* — Insa Sadio
(74) *Attorney, Agent, or Firm* — Knobbe Martens Olson & Bear LLP

(57) ABSTRACT

An organic light-emitting diode (OLED) display is disclosed. In one aspect, the OLED display includes a display unit and a plurality of pixels over the display unit. Each of the pixels comprises first and second sub-pixels each comprising an OLED and a pixel circuit. Each pixel circuit is connected to a first node and a first control line that is configured to supply a first control signal having a rising edge prior to a time when the OLED emits light in a frame. Each pixel circuit is further connected to a second node and a light emitting signal line that is configured to supply a light emitting signal having a falling edge prior to a time when the OLED emits light in the frame. The pixel circuit of the first sub-pixel comprises a first timing compensating capacitor connecting the first node and an anode of the OLED.

20 Claims, 13 Drawing Sheets

(56) References Cited

U.S. PATENT DOCUMENTS

| | | | | |
|---|---|---|---|---|
| 2013/0063330 | A1 | 3/2013 | Eom | |
| 2015/0009194 | A1 | 1/2015 | Kim et al. | |
| 2015/0116266 | A1* | 4/2015 | Inoue | G06F 3/044 345/174 |

FOREIGN PATENT DOCUMENTS

| | | | |
|---|---|---|---|
| KR | 10-2013-0027845 | A | 3/2013 |
| KR | 10-2014-0082041 | A | 7/2014 |
| KR | 10-2015-0006144 | A | 1/2015 |

* cited by examiner

ORGANIC LIGHT-EMITTING DIODE DISPLAY

CROSS-REFERENCE TO RELATED APPLICATION

This application claims the benefit of Korean Patent Application No. 10-2015-0163979, filed on Nov. 23, 2015, in the Korean Intellectual Property Office, the disclosure of which is incorporated herein in its entirety by reference.

BACKGROUND

Field

The described technology generally relates to an organic light-emitting diode (OLED) display.

Description of the Related Technology

An OLED display includes a matrix of pixels with each pixel circuit including an OLED having variable luminance in response to electric current. In the typical configuration, a pixel is composed of multiple sub-pixels to render various colors. In this case, sub-pixels included in one pixel will respectively render different colors.

The sub-pixels include driver circuits that may be designed with different electrical characteristics for various reasons. For example, when one pixel includes a red color sub-pixel, a green color sub-pixel and a blue color sub-pixel, a capacitance formed in an OLED of the green sub-pixel can be greater than those formed in OLEDs of the red and blue color sub-pixels. Such a difference in the capacitance and a difference in magnitude of electric current required for emitting light can cause an undesirable difference in the timing of the light emission. Here the time difference is defined as the difference between the time when current for emitting light is supplied to the OLED of each sub-pixel and the time when a corresponding OLED actually emits light. This time difference can result in a phenomenon known as color dragging.

Information disclosed in this Background section was already known to the inventors before achieving the inventive concept or is technical information acquired in the process of achieving the inventive concept. Therefore, it may contain information that does not form the prior art that is already known to the public in this country.

SUMMARY OF CERTAIN INVENTIVE ASPECTS

One inventive aspect relates to a driving circuit for an OLED pixel.

Another aspect is an OLED display in which driving circuits of sub-pixels to render respectively different colors are implemented in respectively different types.

Another aspect is an OLED display that can control the time difference, that is, from the time when electric current is supplied for emitting light to the organic light emitting diode to the time when the OLED actually emits light.

Another aspect is an OLED display that includes: a display unit; and a plurality of pixels on the display unit, in which each of the plurality of pixels may include a first and second sub-pixels including an OLED and a pixel circuit, in which each of pixel circuits of the first and second sub-pixels may be connected to a first control line supplying a first control signal having a rising edge prior to a time when the OLED emits light in one frame and to a first node, and is connected to a light emitting signal line supplying a light emitting signal having a falling edge prior to a time when the OLED emits light in the one frame and to a second node, in which the pixel circuit of the first sub-pixel may include a first timing compensating capacitor connecting the first node and an anode of the OLED.

Another aspect is an OLED display that includes: a display unit; and a plurality of pixels on the display unit, in which each of the plurality of pixels may include a first and second sub-pixels including an OLED and a pixel circuit, in which each of pixel circuits of the first and second sub-pixels may be connected to a first control line supplying a first control signal having the rising edge prior to a time when the OLED emits light in one frame and to a first node, and is connected to a light emitting signal line supplying a light emitting signal having a falling edge prior to a time when the OLED emits light in the one frame and to a second node, in which the pixel circuit of the second sub-pixel may include a second timing compensating capacitor connecting the second node and an anode of the OLED.

Another aspect is an organic light-emitting diode (OLED) display, comprising: a display unit; and a plurality of pixels in the display unit, wherein each of the pixels comprises first and second sub-pixels, each sub-pixel comprising an OLED and a pixel circuit, wherein each of the pixel circuits of the first and second sub-pixels is connected to a first node and a first control line that is configured to supply a first control signal having a rising edge prior to a time when the OLED emits light in a frame, wherein each pixel circuit is further connected to a second node and a light emitting signal line that is configured to supply a light emitting signal having a falling edge prior to a time when the OLED emits light in the frame, and wherein the pixel circuit of the first sub-pixel comprises a first timing compensating capacitor connecting the first node and an anode of the OLED.

In the above OLED display, the first control signal is configured to determine an initialization time of an anode voltage of the OLED, and wherein the light emitting signal is configured to determine a light emitting time of the OLED. In the above OLED display, each of the pixel circuits further comprises a gate connected to a gate node and a driving transistor configured to supply a driving current to the OLED according to a voltage of the gate. In the above OLED display, each of the pixel circuits comprises a gate initialization transistor configured to change a voltage level of the gate node to a level of a first initialization voltage in response to a second control signal and an anode initialization transistor configured to initialize the voltage level of the anode of the OLED in response to the first control signal. In the above OLED display, the pixel circuit of the first sub-pixel is configured to change the voltage level of the anode of the OLED to the level of the first initialization voltage via the anode initialization transistor, and wherein the pixel circuit of the second sub-pixel is configured to change the voltage level of the anode of the OLED of the second sub-pixel to the level of a second initialization voltage via the anode initialization transistor.

In the above OLED display, the level of the second initialization voltage is identical to the level of a driving voltage supplied to a cathode of the OLED of the second sub-pixel. In the above OLED display, the anode initialization transistor is configured to be turned on in response to at least one of a rising edge voltage and a high flat voltage of the first control signal prior to a time when the OLED emits light via the light emitting signal in one frame. In the above OLED display, the first timing compensating capacitor couples the first node and the anode of the OLED of the first sub-pixel. In the above OLED display, the pixel circuit of the second sub-pixel comprises a second timing compensating capacitor connecting the second node and the anode of the OLED.

In the above OLED display, the second timing compensating capacitor couples the light emitting line and the anode of the OLED of the first sub-pixel. In the above OLED display, a central wavelength of visible light emitted from the first sub-pixel is in the range from about 500 nm to about 600 nm, and wherein the central wavelength of visible light emitted from the second sub-pixel is in the range from about 500 nm to about 600 nm. In the above OLED display, the OLED of the first sub-pixel has a capacitance different from the OLED of the second sub-pixel.

Another aspect is an organic light-emitting (OLED) display, comprising: a display unit; and a plurality of pixels in the display unit, wherein each of the pixels comprises first and second sub-pixels, each sub-pixel comprising an OLED and a pixel circuit, wherein each of the pixel circuits of the first and second sub-pixels is connected to a first node and a first control line that is configured to supply a first control signal having the rising edge prior to a time when the OLED emits light in a frame, wherein each pixel circuit is further connected to a second node and a light emitting signal line that is configured to supply a light emitting signal having a falling edge prior to a time when the OLED emits light in the frame, and wherein the pixel circuit of the second sub-pixel comprises a second timing compensating capacitor connecting the second node and an anode of the OLED.

In the above OLED display, the first control signal is configured to determine an initialization time of an anode voltage of the OLED, and wherein the light emitting signal is configured to determine a light emitting time of the OLED. In the above OLED display, each of the pixel circuits further comprises a gate connected to a gate node and a driving transistor configured to supply a driving current to the OLED according to a voltage of the gate. In the above OLED display, each of the pixel circuits comprises a gate initialization transistor configured to change a voltage level of the gate node to a level of a first initialization voltage in response to a second control signal and an anode initialization transistor configured to initialize the voltage level of the anode of the OLED in response to the first control signal.

In the above OLED display, the pixel circuit of the first sub-pixel is configured to change the voltage level of the anode of the OLED to the level of the first initialization voltage via the anode initialization transistor, and wherein the pixel circuit of the second sub-pixel is configured to change the voltage level of the anode of the OLED of the second sub-pixel to the level of a second initialization voltage via the anode initialization transistor. In the above OLED display, the level of the second initialization voltage is identical to the level of a driving voltage supplied to a cathode of the OLED of the second sub-pixel. In the above OLED display, the anode initialization transistor is configured to be turned on in response to at least one of the rising edge voltage and the high flat voltage of the first control signal prior to a time when the OLED emits light via the light emitting signal in one frame. In the above OLED display, the second timing compensating capacitor couples the light emitting line and the anode of the OLED of the first sub-pixel.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION OF CERTAIN INVENTIVE EMBODIMENTS

Figure 1:
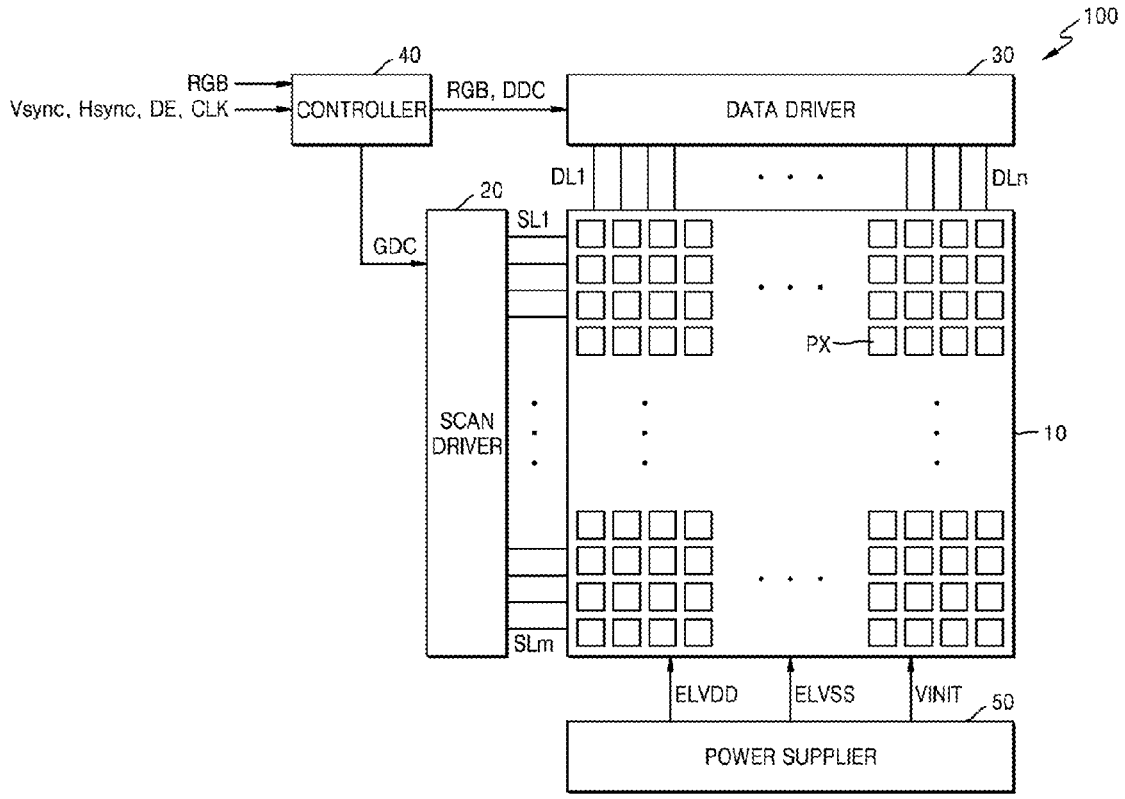
FIG. 1 is a block diagram illustrating an OLED display according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

In this disclosure, the term "substantially" includes the meanings of completely, almost completely or to any significant degree under some applications and in accordance with those skilled in the art. Moreover, "formed, disposed over positioned over" can also mean "formed, disposed or positioned on." The term "connected" includes an electrical connection.

Hereinafter, embodiments will be described in detail with reference to the attached drawings. Like reference numerals in the drawings denote like elements.

While such terms as "first," "second," etc., may be used to describe various components, such components must not be limited to the above terms. The above terms are used only to distinguish one component from another. An expression used in the singular encompasses the expression of the plural, unless it has a clearly different meaning in the context. When a portion is connected to another portion, the case may include not only being directly connected but also being electrically connected with other elements therebetween. When a portion includes a composing element, the case may denote further including other composing elements without excluding other composing elements unless otherwise described.

FIG. 1 is a block diagram illustrating an OLED display 100 according to an embodiment.

Referring to FIG. 1, the OLED display 100 includes a display unit 10, a scan driver 20, a data driver 30, a controller 40, and a power supplier 50.

The display unit 10 may include a plurality of pixels PX arranged in a matrix form. Each pixel PX may be connected to a corresponding scan line among scan lines SL1 through SLm and to a corresponding data line among data lines DL1 through DLn, and a control signal and a data voltage may be provided thereto. Each of scan lines SL1 through SLm is illustrated as a line in FIG. 1. However, some pixels PX may include a plurality of lines to transmit a plurality of control signals in parallel. The power supplier 50 may apply a first driving voltage ELVDD, a second driving voltage ELVSS and an initialization voltage VINIT to the pixels PX. The first driving voltage ELVDD and the second driving voltage ELVSS are driving voltages for an OLED of a pixel to emit light, and the first driving voltage ELVDD may have a higher voltage level than the second driving voltage ELVSS. The initialization voltage VINIT may be used for an adequate operation of a pixel PX. The initialization voltage VINIT is illustrated as a line in FIG. 1; however, the OLED display 100 may supply a plurality of initialization voltages VINIT to pixels PX. The initialization voltage VINIT may have a voltage level similar to that of the second driving voltage ELVSS.

The controller 40 may receive a vertical synchronizing signal Vsync, a horizontal synchronizing signal Hsync, a data enable signal DE, a clock signal CLK, and a data signal RGB from the outside. The controller 40 may control an operation timing of the scan driver 20 and the data driver 30 via timing signals such as the vertical synchronizing signal Vsync, the horizontal synchronizing signal Hsync, the data enable signal DE, and the clock signal CLK. Since the controller 40 may determine a frame period via counting the data enable signal DE during one horizontal scanning period, the vertical synchronizing signal Vsync and the horizontal synchronizing signal Hsync supplied from the outside may be omitted. The data signal RGB may include luminance information of pixels PX. The luminance may have a gray level of certain numbers, for example, 1024, 256 or 64.

The controller 40 may generate control signals including a gate timing control signal GDC to control the operation timing of the scan driver 20 and a data timing control signal DDC to control the operation timing of the data driver 30.

The gate timing control signal GDC may include a gate start pulse GSP, a gate shift clock GSC, a gate output enable GOE signal, etc. The gate start pulse GSP may be supplied to the scan driver 20 in which a first scan signal is generated. The gate shift clock GSC may be a clock signal inputted in common to the scan driver 20 and may be the clock signal to shift the gate start pulse GSP. The gate output enable GOE signal may control an output of the scan driver 20.

The data timing control signal DDC may include a source start pulse SSP, a source sampling clock SSC, a source output enable SOE signal, etc. The source start pulse SSP may be a signal to control a starting time of data sampling of the data driver 30. The source sampling clock SSC may be the clock signal to control a data sampling operation in the data driver 30 based on a rising edge voltage, a falling edge voltage or a certain flat voltage. The source output enable SOE may be a signal to control an output of the data driver 30. The source start pulse SSP supplied to the data driver 30 may be omitted depending on a data transfer method.

The scan driver 20 may sequentially generate control signals to operate transistors of pixels PX included in the display unit 10, in response to the gate timing control signal GDC supplied from the controller 40. The scan driver 20 may supply control signals to pixels PX included in the display unit 10 via scan lines SL1 through SLm. A plurality of control signals may be provided to one pixel PX depending on a design of the pixel PX. For example, first through third control signals or more signals may be provided to one pixel PX during one frame according to a certain sequence.

The data driver 30 may sample the data signal RGB supplied from the controller 40 in a digital type and latch and change the data signal RGB to data in a parallel data system, in response to the data timing control signal DDC supplied from the controller 40. When the data driver 30 changes the data signal RGB in the digital type to data in the parallel data system, the data signal RGB in a digital type may be changed to a gamma-based voltage and to a data voltage in an analog type. The data driver 30 may supply the data voltage to pixels PX included in the display unit 10 via the data lines DL1 through DLn.

Figure 2:
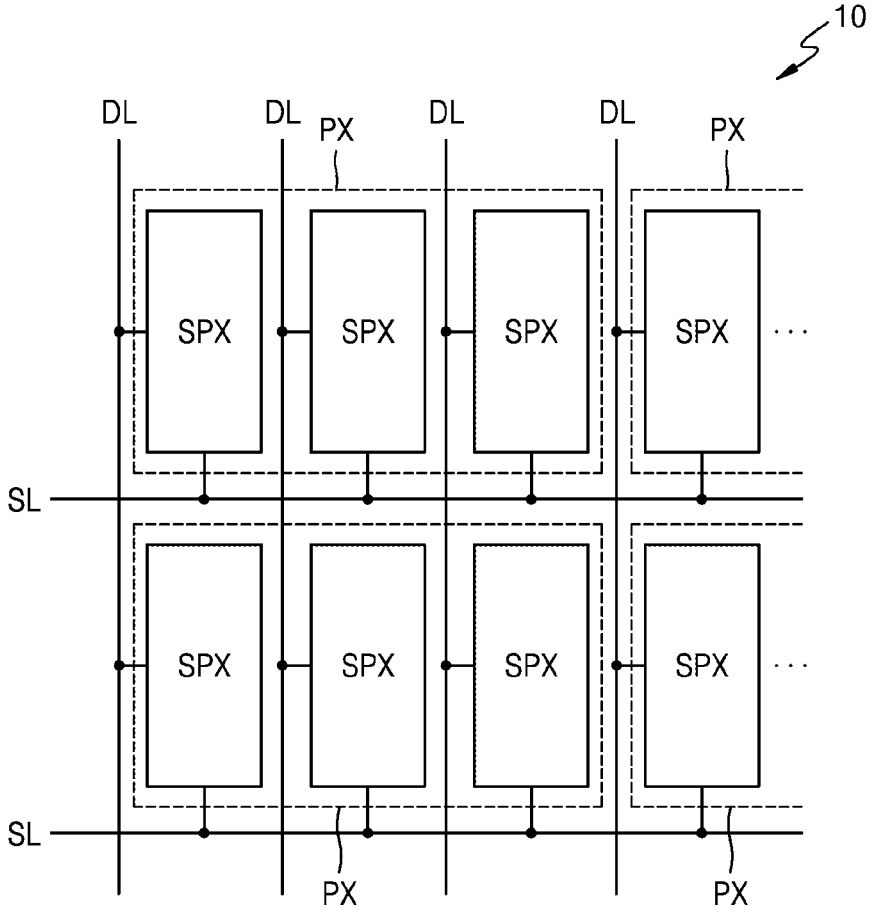
FIG. 2 is a diagram of a structure of a pixel according to an embodiment.

FIG. 2 is a diagram of a structure of a pixel according to an embodiment.

Referring to FIG. 2, a pixel PX may include a plurality of sub-pixels SPX. Each of the sub-pixels SPX may be connected to a corresponding scan line SL among scan lines SL1 through SLm and to a corresponding data line DL among data lines DL1 through DLn. Each of the scan lines SL1 through SLm may provide control signals outputted from the scan driver 20 to sub-pixels SPX on a same row, and each of the data lines DL1 through DLn may provide the data voltage generated from the data driver 30 to sub-pixels SPX on a same column.

The sub-pixel SPX may control the amount of electric current flowing from the first driving voltage ELVDD via the OLED to the second driving voltage ELVSS, based on the data voltage transmitted via a corresponding data line. The data voltage may denote a signal transmitted via a corresponding data line or its voltage level. The OLED of the pixel PX may emit light with luminance corresponding to the data voltage.

At least a portion of the plurality of sub-pixels SPX included in one pixel PX may be sub-pixels SPX to render respectively different colors. Each of the sub-pixels SPX may include a pixel circuit and an OLED. In this case, at least a portion of sub-pixels SPX may include OLEDs emitting light with respectively different wavelengths. Alternatively, at least a portion of sub-pixels SPX may include a color filter transmitting light with respectively different wavelengths.

FIG. 2 illustrates that one pixel PX includes three sub-pixels SPX; however, it is exemplary only. Various arrangements of sub-pixels SPX will be described below.

Figure 3A:
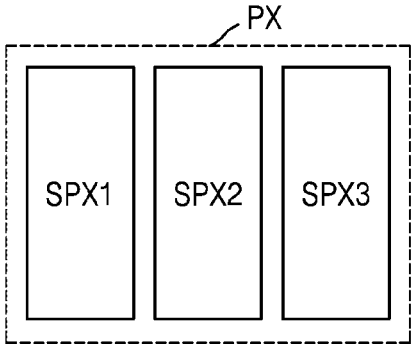
FIGS. 3A through 3C are diagrams illustrating arrangements of sub-pixels according to embodiments.
Figure 3B:
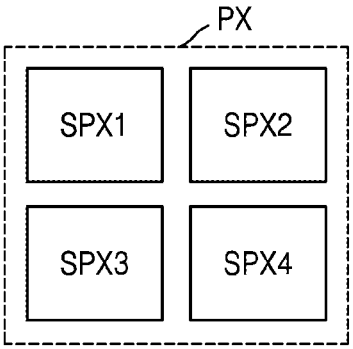
Figure 3C:
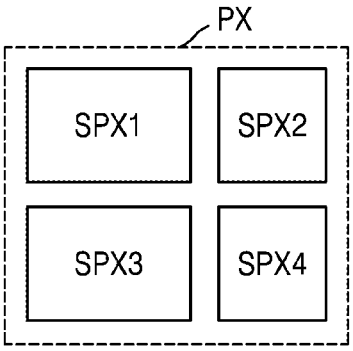

FIG. 3A through 3C are diagrams illustrating arrangements of sub-pixels according to an embodiment.

Referring to FIG. 3A, one pixel PX may be a stripe-shape pixel PX in which a first sub-pixel SPX1, a second sub-pixel SPX2, and a third sub-pixel SPX3 are arranged in parallel with each other. In this case, the first through third sub-pixels SPX1 through SPX3 may be sub-pixels emitting light with respectively different wavelengths. For example, light emitted by each of the first through third sub-pixels SPX1 through SPX3 may be red color, green color and blue color.

Referring to FIG. 3B, one pixel PX may have a configuration in which each of first through fourth sub-pixels SPX1 through SPX4 is arranged at an apex of a rectangle. In this case, the first through fourth sub-pixels SPX1 through SPX4 may be sub-pixels emitting respectively different lights. For example, light emitted by each of the first through fourth sub-pixels SPX1 through SPX4 may be red color, green color, blue color, and white color. Alternatively, a portion of the first through fourth sub-pixels SPX1 through SPX4 may be sub-pixels emitting identical lights. For example, light emitted by the first through fourth sub-pixels SPX1 through SPX4 may be respectively red color, green color, a first blue color, and a second blue color. In this case, the first blue color and the second blue color may be blue colors with an identical wavelength, or may be different blue colors with respectively different central wavelengths in a blue color range wavelength (for example, between about 400 nm and about 500 nm).

Referring to FIG. 3C, one pixel PX may be a pixel PX including first through fourth sub-pixels SPX1 through SPX4 with respectively different sizes and respectively different areas. For example, the first and third sub-pixels SPX1 and SPX3 may be sub-pixels SPX respectively having a larger area than the second and fourth sub-pixels SPX2 and SPX4. In this case, sub-pixels SPX may have different sizes due to a different size of an OLED included in each sub-pixel SPX, or may have different sizes due to a difference in an area arranged for a pixel circuit included in each sub-pixel SPX.

Figure 4:
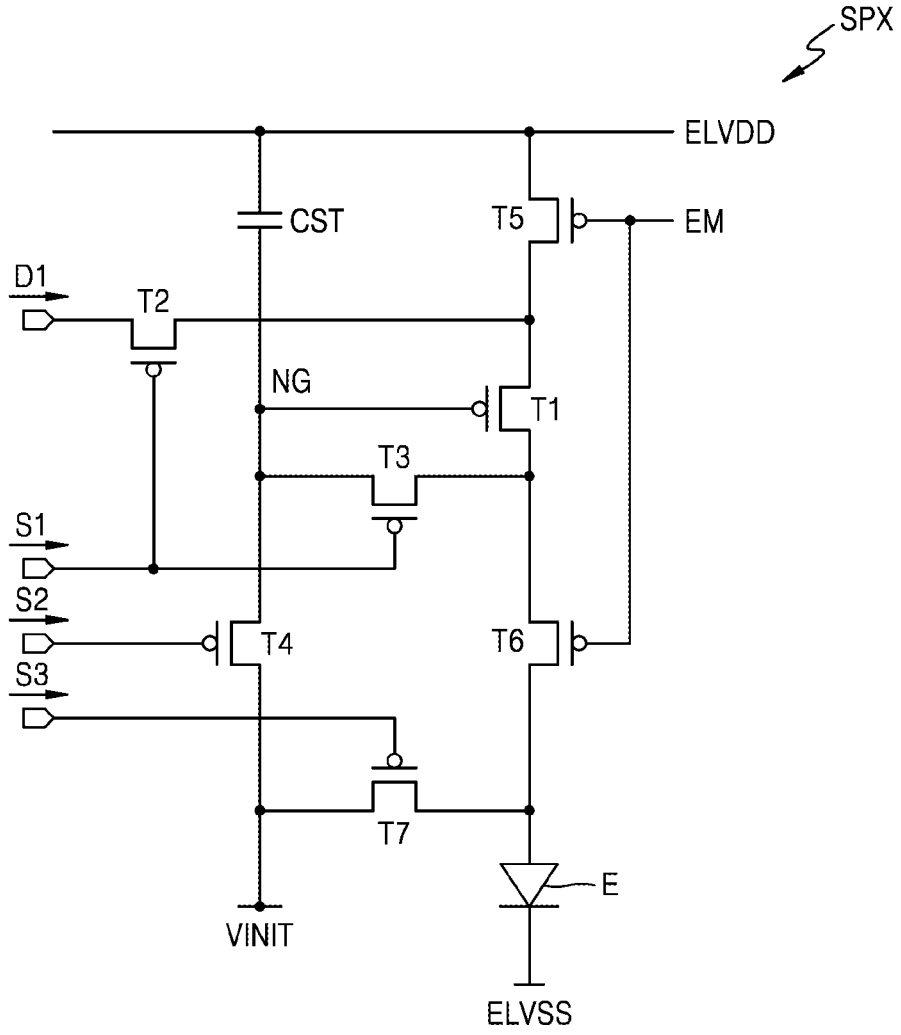
FIG. 4 is a diagram illustrating a structure of a pixel circuit of a sub-pixel according to an embodiment.

FIG. 4 is a diagram illustrating a structure of a pixel circuit of a sub-pixel according to an embodiment.

Referring to FIG. 4, a pixel circuit of a sub-pixel SPX may include an OLED, first through seventh transistors T1 through T7, and a storage capacitor CST.

A gate electrode of the first transistor T1 may be connected to a gate node NG. The source electrode of the first transistor T1 may be connected to a wire supplying the first driving voltage ELVDD via the fifth transistor T5. A drain electrode of the first transistor T1 may be electrically connected to an anode of the OLED via the sixth transistor T6. A current flowing into the OLED may be determined by a difference in voltages of the gate electrode and the source electrode of the first transistor T1. A degree of light emitting of the OLED may be determined by a current amount flowing into the OLED. Thus, the first transistor T1 may be denoted as a driving transistor.

The gate electrode of the second transistor T2 may be connected to a first control line supplying a first control signal S1. A first electrode of the second transistor T2 may be connected to a data line supplying a data voltage D1 and a second electrode may be connected to the source electrode of the first transistor T1. The second transistor T2 may be turned on according to a first control signal S1 received via the first control line and transmit the data voltage D1 transmitted via the data line to the source electrode of the first transistor T1, and the data voltage D1 may be transmitted to the gate electrode of the first transistor T1 due to the third transistor T3 which is simultaneously turned on with the second transistor T2. Thus, the second transistor T2 may be denoted as a switching transistor.

A gate electrode of the third transistor T3 may be connected to the first control line. A first electrode of the third transistor T3 may be connected to the drain electrode of the first transistor T1 and a second electrode may be connected to the gate node NG. The third transistor T3 may be turned on according to the first control signal S1 transmitted via the first control line, connect the gate electrode and the drain electrode together of the first transistor T1, connect the first transistor T1 to the OLED, and compensate for a threshold voltage Vth of the first transistor T1. Thus, the third transistor T3 may be denoted as a compensating transistor.

A gate electrode of the fourth transistor T4 may be connected to a second control line supplying a second control signal S2. A first electrode of the fourth transistor T4 may be connected to an initialization voltage line supplying an initialization voltage VINIT, and a second electrode of the fourth transistor T4 may be connected to the gate node NG. The fourth transistor T4 may be turned on according to the second control signal S2 applied to the second control line, and initialize the gate node NG via transmitting the initialization voltage VINIT to the gate node NG. The initialization voltage VINIT may be set to a voltage higher than a second driving voltage ELVSS or to the second driving voltage ELVSS. Thus, the fourth transistor T4 may be denoted as a gate initialization transistor.

Gate electrodes of the fifth and sixth transistors T5 and T6 may be connected to a light emitting signal line supplying a light emitting signal EM. A first electrode of the fifth transistor T5 may be connected to an electric line supplying the first driving voltage ELVDD, and a second electrode of the fifth transistor T5 may be connected to the source electrode of the first transistor T1. The first electrode of the sixth transistor T6 may be connected to the drain electrode of the first transistor T1, and a second electrode of the sixth transistor T6 may be electrically connected to the anode of the OLED. The fifth and sixth transistors T5 and T6 may be simultaneously turned on according to the light emitting signal EM applied via the light emitting signal line. In this case, the first driving voltage ELVDD may be applied to the first transistor T1 and a driving current may be supplied to the OLED. The fifth and sixth transistors T5 and T6 may be respectively denoted as a first light emitting control transistor and a second light emitting control transistor.

A gate electrode of a seventh transistor T7 may be connected to a third control line supplying a third control signal S3. A first electrode of the seventh transistor T7 may be connected to the anode of the OLED, and a second electrode of the seventh transistor T7 may be connected to the initialization voltage line supplying the initialization voltage VINIT. The seventh transistor T7 may be turned on according to the third control signal S3 applied via the third control line and initialize the anode of the OLED. Thus, the seventh transistor T7 may be denoted as an anode initialization transistor.

The storage capacitor CST may be connected to a point between an electric line supplying the first driving voltage ELVDD and the gate node NG. The storage capacitor CST may store a voltage difference between the first driving voltage ELVDD and the gate node NG.

The anode of the OLED may be connected to one electrode of the sixth and seventh transistors T6 and T7. A cathode of the OLED may be connected to a second power line to which the second driving voltage ELVSS is applied. The OLED may receive the driving current from the first transistor T1 and render an image via light emission. The first driving voltage ELVDD may be a certain high-level voltage and the second driving voltage ELVSS may be a lower voltage than the first driving voltage ELVDD or a ground voltage.

An operation process of a sub-pixel SPX is as follows. During an initialization period, a low-level second control signal S2 may be supplied to the fourth transistor T4 via the second control line, and a low-level third control signal S3 may be supplied to the seventh transistor T7 via the third control line. As a result, the fourth and seventh transistors T4 and T7 may be respectively turned on. The initialization voltage VINIT applied via the initialization voltage line may be transmitted to the gate electrode of the first transistor T1 via the fourth transistor T4, and be transmitted to the anode via the seventh transistor T7. Accordingly, voltages of the gate electrode and the anode of the first transistor T1 may be initialized.

Next, during a data input period, a low-level first control signal S1 may be supplied via the first control line and the second and third transistors T2 and T3 may be turned on. The second transistor T2 may transmit the data voltage D1 from the data line to the source electrode of the first transistor T1, and the first transistor T1 may be connected to the OLED via the third transistor T3. Then, a compensating voltage, which is reduced from the data voltage D1 by the threshold voltage of the first transistor T1, may be applied to the gate electrode of the first transistor T1.

The first driving voltage ELVDD and a compensating voltage may be respectively applied to both terminals of the storage capacitor CST, and an electric charge corresponding to a difference in voltages at both terminals of the storage capacitor CST may be stored in the storage capacitor CST.

Next, during a light emitting period, the light emitting signal EM supplied from the light emitting signal line may change from the high-level to a low-level, and the fifth and sixth transistors T5 and T6 may be turned on. Then, the driving current in response to a voltage difference between a voltage of the gate electrode and the first driving voltage ELVDD may be generated, and the driving current may be supplied to the OLED E via the sixth transistor T6 and light may be emitted.

In this case, all transistors included in the sub-pixel SPX may be p-type transistors.

A time period, that is, from a time point when the light emitting signal EM in the sub-pixel SPX changes from the high-level to the low-level, to a time point when the OLED actually emits light, is described below via the timing diagram.

Figure 5:
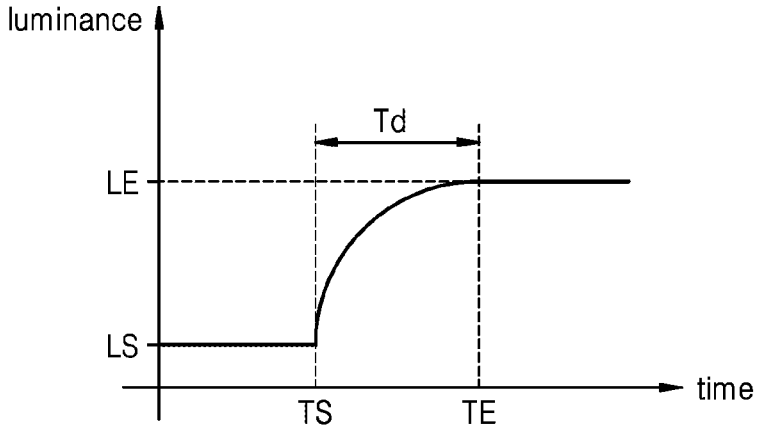
FIG. 5 is a timing diagram illustrating a light emitting operation of the OLED.

FIG. 5 is the timing diagram illustrating a light emitting operation of the OLED.

Referring to FIG. 5, the light emitting signal EM may change from the high-level to the low-level at a light emitting control time TS. In this case, an output luminance of the OLED may change from an initial luminance LS to a target luminance LE. The time, when the output luminance of the OLED reaches the target luminance, may be denoted as a light emitting end time TE. Then, a delay time Td from the light emitting control time TS to the light emitting end time TE may be calculated via an arithmetic formula below;

$$Td=TE-TS=(CEL\times(Vth_{el}+ELVSS-VINIT))/I_{T1}. \quad \text{FORMULA 1}$$

CEL may denote a capacitance of the OLED, $Vth_{el}$ may denote a voltage between the anode and the cathode of the OLED, and $I_{T1}$ may denote a current flow from the source electrode of the first transistor T1 to the drain electrode of the first transistor T1. When an identical gray level needs to be outputted, the delay time Td between sub-pixels SPX rendering respectively different colors may be different. This issue will be described in detail with reference to FIG. 6.

Figure 6:
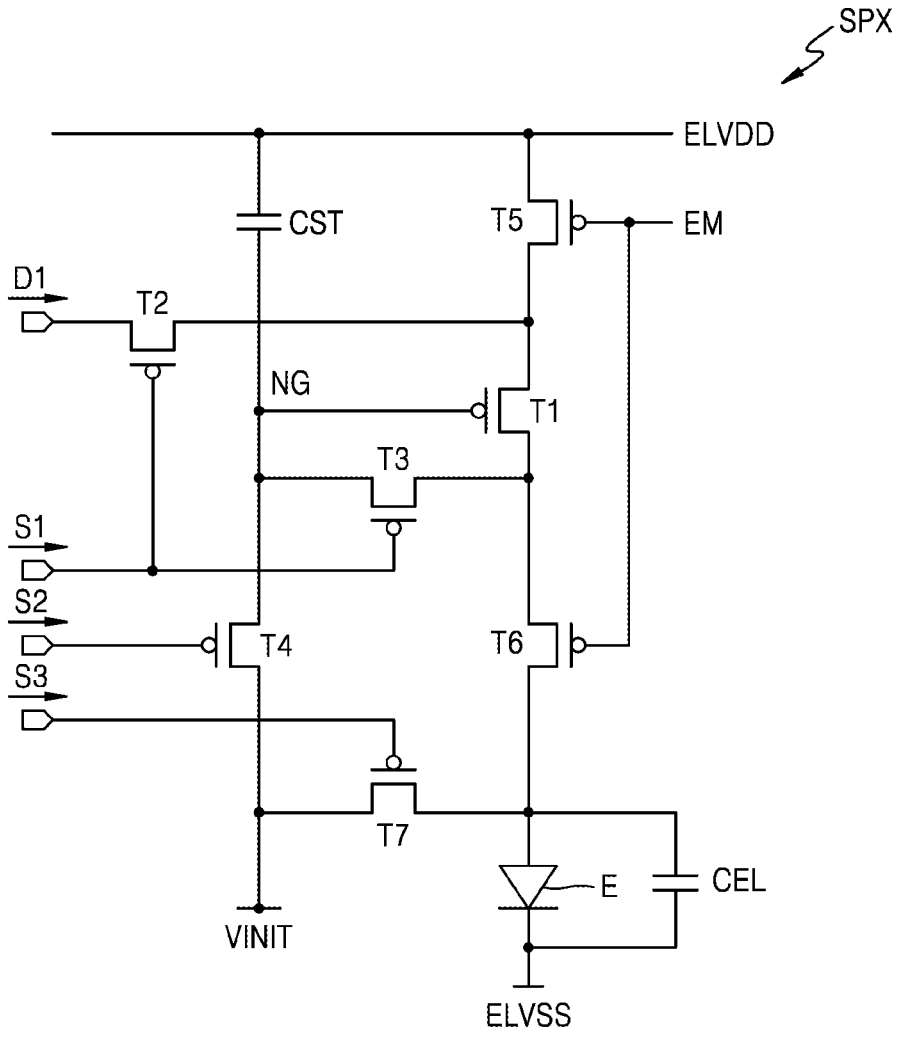
FIG. 6 is a diagram illustrating a capacitance of an OLED included in a pixel circuit according to an embodiment.

FIG. 6 is a diagram illustrating a capacitance of an OLED included in a pixel circuit according to an embodiment.

Referring to FIG. 6, the pixel circuit of the sub-pixel SPX may include the OLED, the first through seventh transistors T1 through T7, and the storage capacitor CST. In this case, a capacitance CEL of the OLED may be generated between the anode and the cathode of the OLED. The capacitance CEL of the OLED may vary depending on colors to be rendered via the sub-pixel SPX. For example, an area of a green color sub-pixel SPX of the OLED may be larger than that of a red color sub-pixel SPX of the OLED or that of a blue color sub-pixel SPX of the OLED. Accordingly, the capacitance CEL of the green color sub-pixel SPX of the OLED E may be larger than that of the red color sub-pixel SPX of the OLED or that of the blue color sub-pixel SPX of the OLED. Then, as may be verified via the formula 1 above, the delay time Td of the green sub-pixel SPX may be longer than that of the red or blue color sub-pixel SPX. As a result, when an identical gray level is applied to all sub-pixels SPX, the green color may be emitted after other colors. Thus, a color dragging phenomenon may occur in which the red or blue color is acknowledged as leading while the green color is recognized as lagging.

Figure 7:
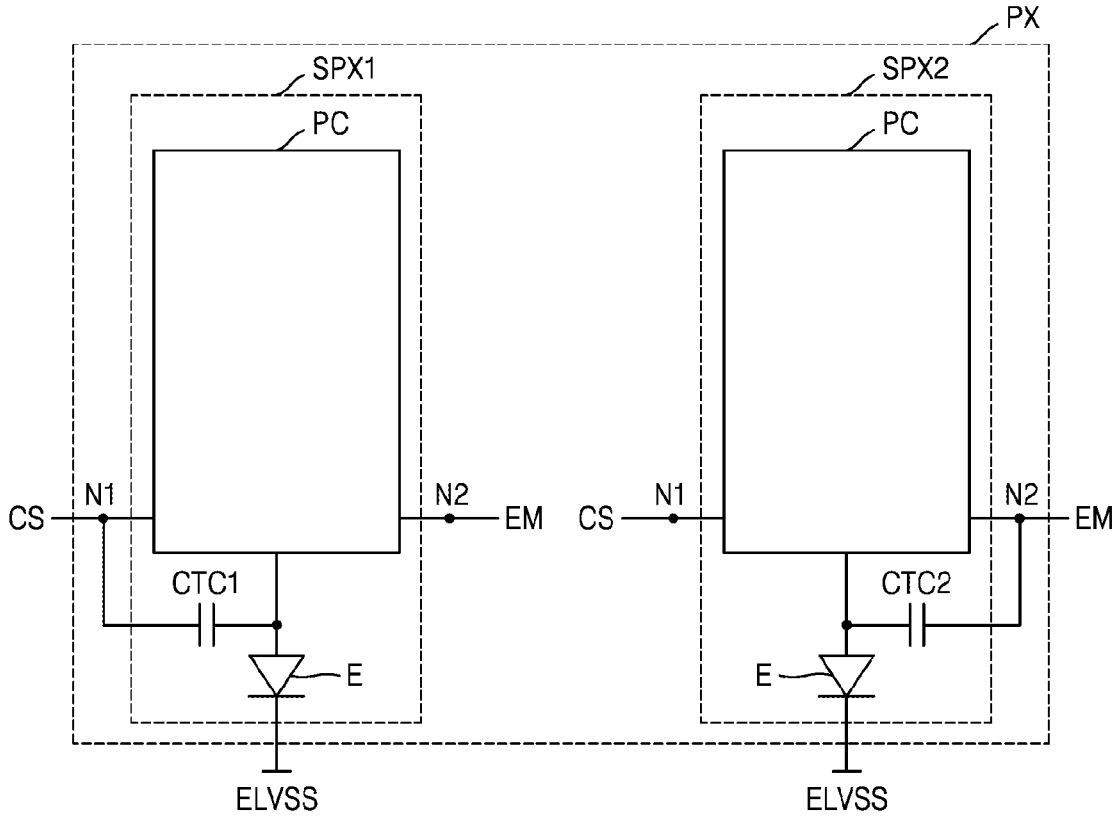
FIG. 7 is a diagram illustrating a structure of a pixel circuit of a sub-pixel according to an embodiment.

FIG. 7 is a diagram illustrating a structure of a pixel circuit of a sub-pixel according to an embodiment.

Referring to FIG. 7, one pixel PX may include first and second sub-pixels SPX1 and SPX2. Each of the first and second sub-pixels SPX1 and SPX2 may include a pixel circuit PC and an OLED. In this case, the pixel circuit PC of the first and second sub-pixels SPX1 and SPX2 may receive, via a first node N1, a control signal CS having the rising edge prior to a time when the OLED emits light. In addition, the pixel circuit PC of the first and second sub-pixels SPX1 and SPX2 may receive, via a second node N2, the light emitting signal EM having the falling edge prior to a time when the OLED emits light in one frame.

In this case, the pixel circuit PC of the first sub-pixel SPX1 may include a first timing compensating capacitor CTC1 connecting the first node N1 and the anode of the OLED. For example, the first timing compensating capacitor CTC1 couples the first node N1 and the anode of the OLED. In this case, since the control signal CS has the rising edge prior to a time when the OLED emits light, an anode voltage of the OLED may increase at the time when the rising edge of the control signal CS occurs or during the time when a high flat voltage is applied after the occurrence of the rising edge. As a result, the voltage level of the anode of the OLED may reach a target voltage level for light emitting somewhat more quickly, at the time when the OLED emits light.

The control signal CS may be a signal determining a time to apply the data voltage. For example, the control signal CS is the first control signal S1 described via FIG. 4. Alternatively, the control signal CS may be a signal determining an initialization time of a gate voltage of the first transistor T1 supplying the driving voltage to the OLED. For example, the control signal CS is the second control signal S2 described via FIG. 4. Alternatively, the control signal CS may be a signal determining the initialization time of the anode voltage of the OLED. For example, the control signal CS is the third control signal S3 described via FIG. 4. A case in which the control signal CS is the third control signal S3 described via FIG. 4 will be described as an example below.

The first sub-pixel SPX1 may be a green color sub-pixel SPX in which a central wavelength of an emitted light may be in the range from about 500 nm to about 600 nm. As described via FIG. 6, a capacitance value CEL of the OLED of the green color sub-pixel SPX may be larger than that of the red color or blue color sub-pixel SPX and thus, the color dragging phenomenon may occur according to a difference in the delay time between sub-pixels SPX. In this case, when the first timing compensating capacitor CTC1 connecting the first node N1 and the anode of the OLED is included in the green color sub-pixel SPX, the voltage level of the anode of the OLED may have the voltage level slightly increased from the initialization voltage VINIT at the time when the OLED emits light via the light emitting signal EM. As a result, a delay time $Td_G$ from the light emitting control time TS to the light emitting end time TE in the green color sub-pixel SPX may be calculated via an arithmetic formula below;

$$Td_G=TE-TS=(CEL\times(Vth_{el}+ELVSS-(VINIT+VD1)))/I_{T1}. \quad \text{FORMULA 2}$$

VD1 may be an increased voltage due to the high flat voltage at the rising edge of the control signal CS or thereafter. As a result, the delay time $Td_G$ of the green sub-pixel SPX may decrease and the color dragging phenomenon may decrease.

The pixel circuit PC of the second sub-pixel SPX2 may include a second timing compensating capacitor CTC2 connecting a second node N2 and the anode of the OLED. For example, the second timing compensating capacitor CTC2 couples the second node N2 and the anode of the OLED. In this case, since the light emitting signal EM has the falling edge prior to a time when the OLED emits light, the anode voltage of the OLED may decrease at the time when the falling edge of the light emitting signal EM occurs or during the time when a low flat voltage is applied after the occurrence of the falling edge. As a result, the voltage level of the anode of the OLED may reach the target voltage level for light emitting somewhat more slowly, at the time when the OLED emits light.

The light emitting signal EM may be a signal determining a time of light emitting of the OLED of the pixel circuit PC. For example, the light emitting signal EM as the light emitting signal EM described via FIG. 4 is a signal applied to the gate of the fifth and sixth transistors T5 and T6.

The second sub-pixel SPX2 may be a red color or blue color sub-pixel SPX in which a central wavelength of an emitted light may be in the range from about 500 nm to about 600 nm. As described via FIG. 6, a capacitance value CEL of the OLED of the red color or blue color sub-pixel SPX may be smaller than that of the green color sub-pixel SPX and thus, the color dragging phenomenon may occur according to a difference in the delay time between sub-pixels SPX. In this case, when the second timing compensating capacitor CTC2 connecting the second node N2 and the anode of the OLED is included in the red color or blue color sub-pixel SPX, the voltage level of the anode of the OLED may have the voltage level slightly decreased from the initialization voltage VINIT at the time when the OLED emits light via the light emitting signal EM. As a result, a delay time $Td_{RB}$ from the light emitting control time TS to the light emitting end time TE in the red color or blue color sub-pixel SPX may be calculated via an arithmetic formula below;

$$Td_{RB}=TE-TS=(CEL\times(Vth_{el}+ELVSS-(VINIT+VD2)))/I_{TI}. \quad \text{FORMULA 3}$$

VD2 may be a decreased voltage due to the low flat voltage at the falling edge of the light emitting signal EM or thereafter. As a result, the delay time $Td_{RB}$ of the red color or blue color sub-pixel SPX may increase and the color dragging phenomenon may decrease.

FIGS. 8A through 8D are diagrams illustrating structures of a pixel circuit of a sub-pixel according to embodiments.

Figure 8A:
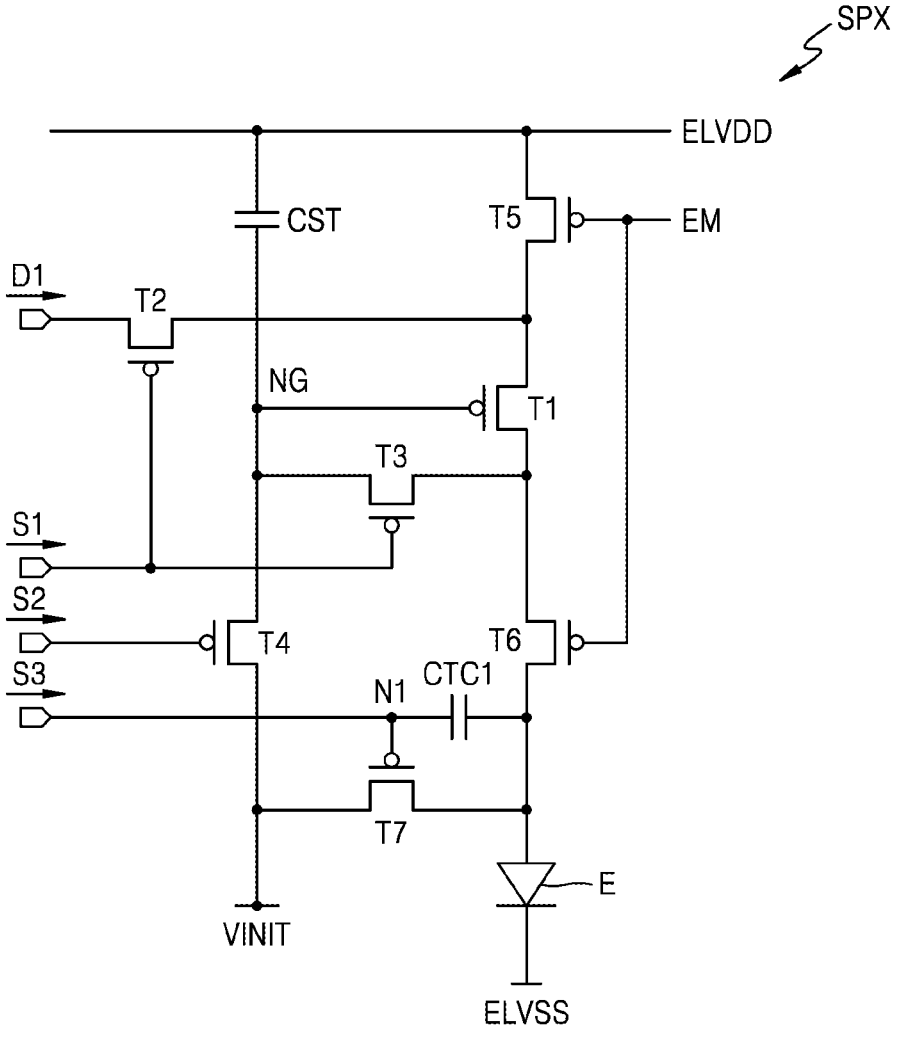
FIGS. 8A through 8D are diagrams illustrating structures of a pixel circuit of a sub-pixel according to embodiments.

Referring to FIG. 8A, the pixel circuit of the sub-pixel SPX may include an OLED, the first through seventh transistors T1 through T7, the storage capacitor CST, and the first timing compensating capacitor CTC1 connecting the anode of the OLED and the third control line applying the third control signal S3. The sub-pixel SPX may include the gate connected to the gate node NG and the first transistor T1 supplying the driving current to the OLED according to the gate voltage. In addition, the sub-pixel SPX may include the fourth transistor T4 changing the voltage level of the gate node NG to the initialization voltage VINIT in response to the second control signal S2. In addition, the sub-pixel SPX may include the seventh transistor T7 changing the voltage level of the anode of the OLED to a level of an initialization voltage VINIT in response to the third control signal S3. In this case, the seventh transistor T7 may be turned on in response to at least one of the rising edge voltage and the high flat voltage thereafter of the third control signal S3 prior to a time when a light emitting time of the OLED due to the light emitting signal EM in one frame, and may initialize the anode voltage of the OLED via the initialization voltage VINIT. In this case, the first timing compensating capacitor CTC1 may adjust the anode voltage to have the voltage level somewhat increased from the level of the initialization voltage VINIT. As a result, the voltage level of the anode of the OLED may reach the target voltage level for light emitting somewhat more quickly at the time when the OLED emits light via the light emitting signal EM.

When the first timing compensating capacitor CTC1 is included, as illustrated in FIG. 8A, in a sub-pixel SPX which has a relatively long delay time Td, from the light emitting control time TS to the light emitting end time TE, among sub-pixels SPX included in one pixel PX, an effect of a decreased delay time Td may be obtained and accordingly, the color dragging phenomenon may decrease.

Figure 8B:
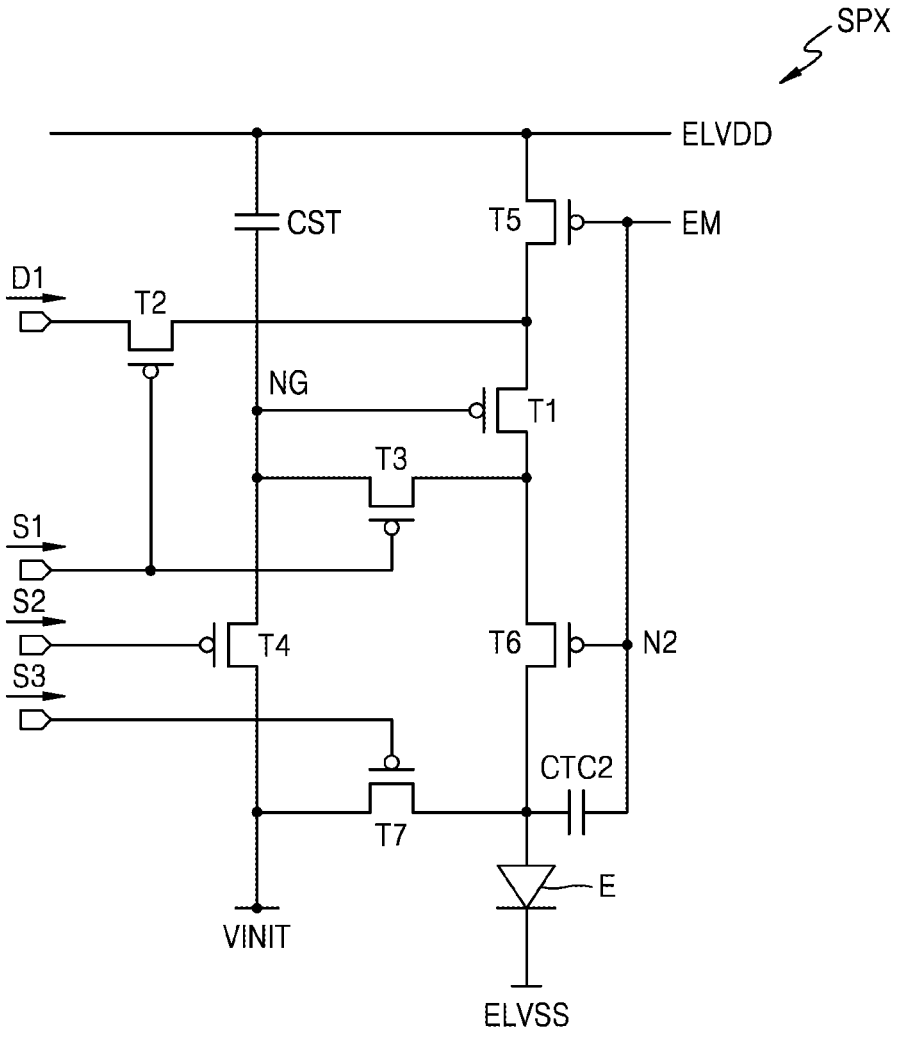

Referring to FIG. 8B, the pixel circuit of the sub-pixel SPX may include an OLED, the first through seventh transistors T1 through T7, a storage capacitor CST, and a second timing compensating capacitor CTC2 connecting the anode of the OLED and a light emitting signal line applying the light emitting signal EM. The sub-pixel SPX may include a gate connected to the gate node NG and the first transistor T1 supplying the driving voltage to the OLED according to the gate voltage. In addition, the sub-pixel SPX may include the fourth transistor T4 changing the voltage level of the gate node NG to the level of the initialization voltage VINIT in response to the second control signal S2. In addition, the sub-pixel SPX may include the seventh transistor T7 changing the level of the anode voltage of the OLED to the level of the initialization voltage VINIT in response to the third control signal S3. In this case, when the light emitting signal EM is about to have the falling edge in one frame, the fifth and sixth transistors T5 and T6 become open and a current for light emitting may be applied to the OLED. For example, the falling edge of the light emitting signal EM occurs at a time earlier than the time when the OLED actually emits light. In this case, the second timing compensating capacitor CTC2 may adjust the anode voltage to the voltage level somewhat decreased from the level of the initialization voltage VINIT due to the low flat voltage at the time of the falling edge or right after the falling edge of the light emitting signal EM. As a result, the voltage level of the anode of the OLED may reach the target voltage level for light emitting somewhat more slowly, at the time when the driving current for light emitting is applied to the anode of the OLED.

When the second timing compensating capacitor CTC2 is included, as illustrated in FIG. 8B, in a sub-pixel SPX which has a relatively long delay time Td, from the light emitting control time TS to the light emitting end time TE, among sub-pixels SPX included in one pixel PX, an effect of an increased delay time Td may be obtained and accordingly, the color dragging phenomenon may decrease.

Figure 8C:
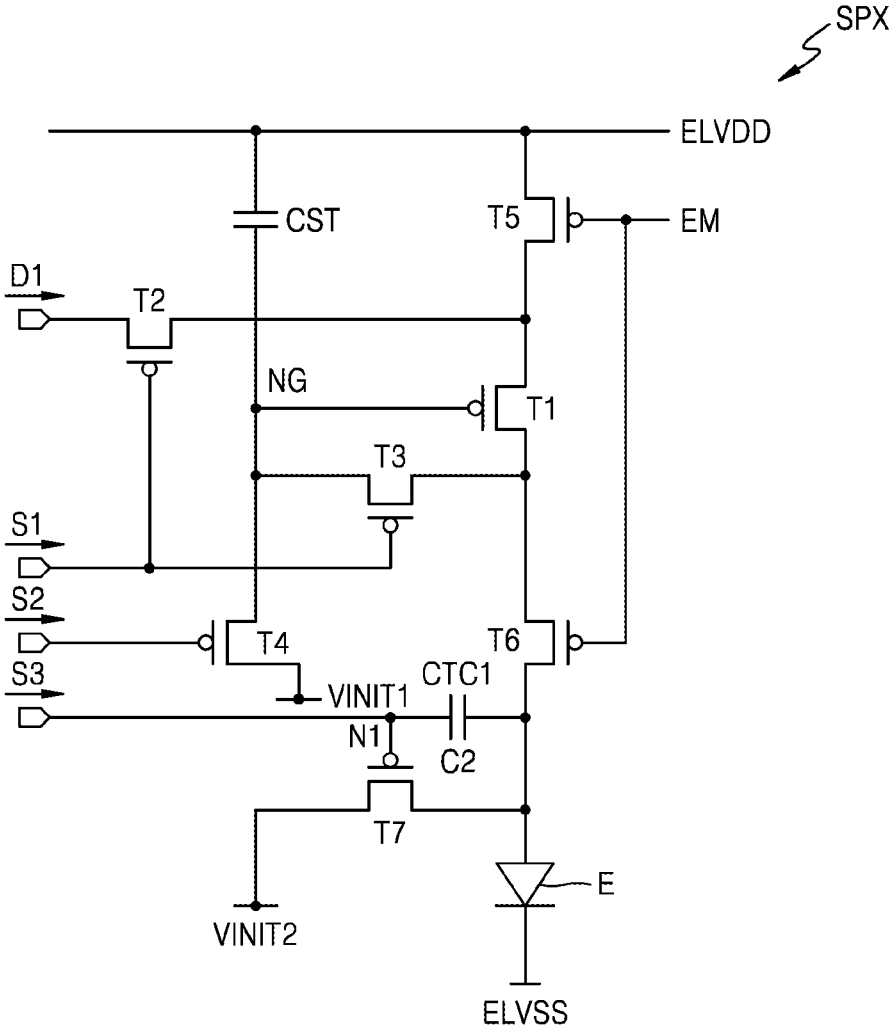

More than two initialization voltages may be applied to the pixel circuit of the sub-pixel SPX. Referring to FIG. 8C, the pixel circuit of the sub-pixel SPX may include an OLED, the first through seventh transistors T1 through T7, a storage capacitor CST, and the first timing compensating capacitor CTC1 connecting the anode of the OLED and the third control line applying the third control signal S3. The sub-pixel SPX may include the gate connected to the gate node NG and the first transistor T1 supplying the driving current to the OLED according to the gate voltage. In addition, the sub-pixel SPX may include the fourth transistor T4 changing the voltage level of the gate node NG to the initialization voltage VINIT in response to the second control signal S2.

In addition, the sub-pixel SPX may include the seventh transistor T7 changing the voltage level of the anode of the OLED to the level of the initialization voltage VINIT in response to the third control signal S3.

The voltage level of the gate of the first transistor T1 and the voltage level of the anode of the OLED may be initialized to the level of the second driving voltage ELVSS. For example, the voltage levels supplied to the fourth and seventh transistor T4 and T7 is substantially identical to the level of the second driving voltage ELVSS. However, there may be a case when the level of the second driving voltage ELVSS is changed for a purpose of a consumed power reduction, etc. In this case, when the second driving voltage ELVSS is used as the initialization voltage, the initialization voltage level of the gate of the first transistor T1 may be affected, and accordingly, the delay time Td of the OLED per sub-pixel SPX may result in an increase or a decrease. Thus, as illustrated in FIG. 8C, a first initialization voltage VINIT1 for initializing the voltage level of the gate of the first transistor T1 may be separately prepared so that the delay time Td of the sub-pixel SPX may not change, while a second initialization voltage VINIT2 for initializing the voltage level of the anode of the OLED may use the second driving voltage ELVSS as is. With this configuration, the color dragging phenomenon due to a level change in the second driving voltage ELVSS may decrease.

Figure 8D:
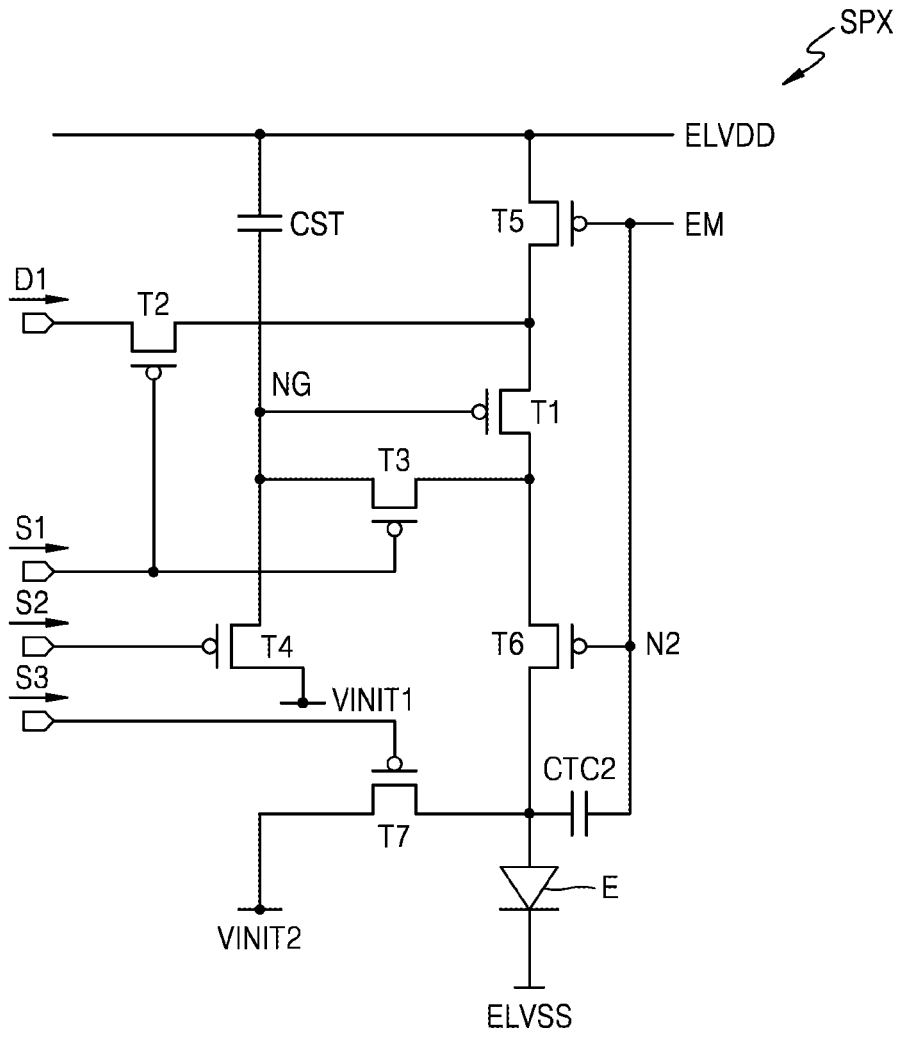

Similarly, referring to FIG. 8D, the pixel circuit of the sub-pixel SPX may include an OLED, the first through seventh transistors T1 through T7, a storage capacitor CST, and a second timing compensating capacitor CTC2 connecting the anode of the OLED and a light emitting signal line applying the light emitting signal EM. The sub-pixel SPX may include a gate connected to the gate node NG and the first transistor T1 supplying the driving voltage to the OLED according to the gate voltage. In addition, the sub-pixel SPX may include the fourth transistor T4 changing the voltage level of the gate node NG to the level of the initialization voltage VINIT in response to the second control signal S2. In addition, the sub-pixel SPX may include the seventh transistor T7 changing the voltage level of the anode of the OLED to the level of the initialization voltage VINIT in response to the third control signal S3.

The voltage level of the gate of the first transistor T1 and the voltage level of the anode of the OLED may be initialized to the level of the second driving voltage ELVSS. For example, the voltage levels supplied to the fourth and seventh transistor T4 and T7 is substantially identical to the level of the second driving voltage ELVSS. However, there may be a case when the level of the second driving voltage ELVSS is changed for a purpose of a consumed power reduction, etc. In this case, when the second driving voltage ELVSS is used as the initialization voltage, the initialization voltage level of the gate of the first transistor T1 may be affected, and accordingly, the delay time Td of the OLED per sub-pixel SPX may result in an increase or a decrease. Thus, as illustrated in FIG. 8D, a first initialization voltage VINIT1 for initializing the voltage level of the gate of the first transistor T1 may be separately prepared so that the delay time Td of the sub-pixel SPX may not change, while a second initialization voltage VINIT2 for initializing the voltage level of the anode of the OLED may use the second driving voltage ELVSS as is. With this configuration, the color dragging phenomenon due to a level change in the second driving voltage ELVSS may decrease.

The steps of all methods described herein can be performed in any suitable order unless otherwise indicated herein or otherwise clearly contradicted by context. The inventive concept is not limited to the described order of the steps. The use of any and all examples, or exemplary language (e.g., "such as") provided herein, is intended merely to better illuminate the inventive concept and does not pose a limitation on the scope of the inventive concept unless otherwise claimed. The particular implementations shown and described herein are illustrative examples of the inventive concept and are not intended to otherwise limit the scope of the inventive concept in any way. For the sake of brevity, conventional electronics, control systems, software development and other functional aspects of the systems may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the inventive concept unless the element is specifically described as "essential" or "critical." The use of the terms "a" and "an" and "the" and similar referents in the context of describing the inventive concept (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein.

It should be understood that embodiments described herein should be considered in a descriptive sense only and not for purposes of limitation. Descriptions of features or aspects within each embodiment should typically be considered as available for other similar features or aspects in other embodiments.

While the inventive technology has been described with reference to the figures, it will be understood by those of ordinary skill in the art that various changes in form and details may be made therein without departing from the spirit and scope as defined by the following claims.

What is claimed is:

1. An organic light-emitting diode (OLED) display, comprising:

a display unit; and a plurality of pixels in the display unit, wherein each of the pixels comprises first and second sub-pixels, each sub-pixel comprising an OLED and a pixel circuit, wherein each of the pixel circuits of the first and second sub-pixels is connected to a first node and a first control line that is configured to supply a first control signal having a rising edge prior to a time when the OLED emits light in a frame, wherein each pixel circuit is further connected to a second node and a light emitting signal line that is configured to supply a light emitting signal having a falling edge prior to a time when the OLED emits light in the frame, and wherein the pixel circuit of the first sub-pixel comprises a first timing compensating capacitor connecting the first node and an anode of the OLED.

2. The OLED display of claim 1, wherein the first control signal is configured to determine an initialization time of an anode voltage of the OLED, and wherein the light emitting signal is configured to determine a light emitting time of the OLED.

3. The OLED display of claim 1, wherein each of the pixel circuits further comprises a gate connected to a gate node and a driving transistor configured to supply a driving current to the OLED according to a voltage of the gate.

4. The OLED display of claim 3, wherein each of the pixel circuits comprises a gate initialization transistor configured to change a voltage level of the gate node to a level of a first initialization voltage in response to a second control signal and an anode initialization transistor configured to initialize the voltage level of the anode of the OLED in response to the first control signal.

5. The OLED display of claim 4, wherein the pixel circuit of the first sub-pixel is configured to change the voltage level of the anode of the OLED to the level of the first initialization voltage via the anode initialization transistor, and wherein the pixel circuit of the second sub-pixel is configured to change the voltage level of the anode of the OLED of the second sub-pixel to the level of a second initialization voltage via the anode initialization transistor.

6. The OLED display of claim 5, wherein the level of the second initialization voltage is identical to the level of a driving voltage supplied to a cathode of the OLED of the second sub-pixel.

7. The OLED display of claim 4, wherein the anode initialization transistor is configured to be turned on in response to at least one of a rising edge voltage and a high flat voltage of the first control signal prior to a time when the OLED emits light via the light emitting signal in one frame.

8. The OLED display of claim 7, wherein the first timing compensating capacitor couples the first node and the anode of the OLED of the first sub-pixel.

9. The OLED display of claim 1, wherein the pixel circuit of the second sub-pixel comprises a second timing compensating capacitor connecting the second node and the anode of the OLED.

10. The OLED display of claim 9, wherein the second timing compensating capacitor couples the light emitting line and the anode of the OLED of the first sub-pixel.

11. The OLED display of claim 1, wherein a central wavelength of visible light emitted from the first sub-pixel is in the range from about 500 nm to about 600 nm, and wherein the central wavelength of visible light emitted from the second sub-pixel is in the range from about 500 nm to about 600 nm.

12. The OLED display of claim 1, wherein the OLED of the first sub-pixel has a capacitance different from the OLED of the second sub-pixel.

13. An organic light-emitting (OLED) display, comprising:

a display unit; and a plurality of pixels in the display unit, wherein each of the pixels comprises first and second sub-pixels, each sub-pixel comprising an OLED and a pixel circuit, wherein each of the pixel circuits of the first and second sub-pixels is connected to a first node and a first control line that is configured to supply a first control signal having the rising edge prior to a time when the OLED emits light in a frame, wherein each pixel circuit is further connected to a second node and a light emitting signal line that is configured to supply a light emitting signal having a falling edge prior to a time when the OLED emits light in the frame, and wherein the pixel circuit of the second sub-pixel comprises a second timing compensating capacitor connecting the second node and an anode of the OLED.

14. The OLED display of claim 13, wherein the first control signal is configured to determine an initialization time of an anode voltage of the OLED, and wherein the light emitting signal is configured to determine a light emitting time of the OLED.

15. The OLED display of claim 13, wherein each of the pixel circuits further comprises a gate connected to a gate node and a driving transistor configured to supply a driving current to the OLED according to a voltage of the gate.

16. The OLED display of claim 15, wherein each of the pixel circuits comprises a gate initialization transistor configured to change a voltage level of the gate node to a level of a first initialization voltage in response to a second control signal and an anode initialization transistor configured to initialize the voltage level of the anode of the OLED in response to the first control signal.

17. The OLED display of claim 16, wherein the pixel circuit of the first sub-pixel is configured to change the voltage level of the anode of the OLED to the level of the first initialization voltage via the anode initialization transistor, and wherein the pixel circuit of the second sub-pixel is configured to change the voltage level of the anode of the OLED of the second sub-pixel to the level of a second initialization voltage via the anode initialization transistor.

18. The OLED display of claim 17, wherein the level of the second initialization voltage is identical to the level of a driving voltage supplied to a cathode of the OLED of the second sub-pixel.

19. The OLED display of claim 16, wherein the anode initialization transistor is configured to be turned on in response to at least one of the rising edge voltage and the high flat voltage of the first control signal prior to a time when the OLED emits light via the light emitting signal in one frame.

20. The OLED display of claim 13, wherein the second timing compensating capacitor couples the light emitting line and the anode of the OLED of the first sub-pixel.

* * * * *